US011377866B1

(12) United States Patent
Conlon

(10) Patent No.: US 11,377,866 B1
(45) Date of Patent: Jul. 5, 2022

(54) BEACH UMBRELLA ANCHORING AND STABILIZING DEVICE

(71) Applicant: Derek Conlon, Bronx, NY (US)

(72) Inventor: Derek Conlon, Bronx, NY (US)

( * ) Notice: Subject to any disclaimer, the term of this patent is extended or adjusted under 35 U.S.C. 154(b) by 21 days.

(21) Appl. No.: 17/122,925

(22) Filed: Dec. 15, 2020

(51) Int. Cl.

| | |
|---|---|
| ***E04H 12/00*** | (2006.01) |
| ***E04H 12/22*** | (2006.01) |
| ***A45B 23/00*** | (2006.01) |
| ***A47B 37/04*** | (2006.01) |

(52) U.S. Cl.
CPC ..... *E04H 12/2246* (2013.01); *A45B 23/00* (2013.01); *A47B 37/04* (2013.01); *E04H 12/2269* (2013.01); *A45B 2023/0012* (2013.01); *A45B 2200/1063* (2013.01)

(58) Field of Classification Search
None
See application file for complete search history.

(56) References Cited

U.S. PATENT DOCUMENTS

| | | | | |
|---|---|---|---|---|
| 3,342,444 | A | 9/1967 | Nelson | |
| 4,269,010 | A | 5/1981 | Glass | |
| 5,143,108 | A | 9/1992 | Kenney | |
| 5,271,196 | A | 12/1993 | Fanti | |
| 5,636,944 | A | 6/1997 | Buttimore | |
| 6,446,649 | B1 | 9/2002 | Bigford | |
| 6,889,953 | B2 | 5/2005 | Harbaugh | |
| 8,783,274 | B1 | 7/2014 | Supino | |
| 9,540,840 | B2 | 1/2017 | Ma | |
| 9,890,551 | B1 * | 2/2018 | Delao | E04H 15/62 |
| 10,344,496 | B1 | 7/2019 | Cefalo | |
| 2002/0036008 | A1 | 3/2002 | Hickam et al. | |
| 2004/0069922 | A1 | 4/2004 | Wu | |
| 2004/0129184 | A1 | 7/2004 | Kraker | |
| 2006/0016950 | A1 | 1/2006 | Bright et al. | |
| 2009/0114795 | A1 | 5/2009 | Giannetto | |
| 2010/0200724 | A1 * | 8/2010 | Kukuk | A45B 25/00 248/530 |

(Continued)

OTHER PUBLICATIONS

Written Opinion of the International Searching Authority for PCT/US2021/036783 established by the ISA/US completed on Sep. 1, 2021.

(Continued)

*Primary Examiner* — Steven M Marsh
(74) *Attorney, Agent, or Firm* — Goldstein Law Offices, P.C.

(57) ABSTRACT

A beach umbrella anchoring and stabilizing device includes a support shaft having a proximal end, a distal end, and a hollow interior for receiving a beach umbrella. An anchoring container affixed to the support shaft includes an open top, a closed bottom, and a sidewall extending around the support shaft from the open top to the closed bottom. The sidewall defines a laterally extending reservoir for receiving sand to anchor the device underneath the beach surface and provide lateral support to a beach umbrella mounted into the support shaft. Stabilizing vanes protrude from the distal end of the support shaft and extend from the closed bottom to the distal end. Each of the stabilizing vanes defines a broad surface that engages sand when a rotational force is exerted onto the support shaft, thereby preventing rotation of the support shaft about a longitudinal axis thereof when buried under the sand.

13 Claims, 10 Drawing Sheets

(56) References Cited

U.S. PATENT DOCUMENTS

| | | | | |
|---|---|---|---|---|
| 2012/0126089 | A1* | 5/2012 | Silvestri | E04H 12/2269 248/530 |
| 2013/0092199 | A1* | 4/2013 | Berland | A45B 25/00 135/25.1 |
| 2015/0013734 | A1 | 1/2015 | Krystopher et al. | |
| 2017/0295925 | A1 | 10/2017 | Taylor | |
| 2018/0106062 | A1* | 4/2018 | Brady | A45B 25/00 |

OTHER PUBLICATIONS

International Preliminary Report on Patentability of the International Preliminary Examining Authority for PCT/US2021/036783 established by the IPEA/US completed on Jan. 24, 2022.

* cited by examiner

BEACH UMBRELLA ANCHORING AND STABILIZING DEVICE

TECHNICAL FIELD

The present disclosure relates generally to umbrella anchors. More particularly, the present disclosure relates to a beach umbrella sand anchoring and stabilizing device including an anchoring container for burying in and containing sand and stabilizing vanes for preventing rotation of a beach umbrella about its longitudinal axis.

BACKGROUND

Beach umbrellas are frequently used by beachgoers to provide an area of shade or shelter to protect them from direct sunrays and provide a somewhat protected area for their various beach items. Conventional beach umbrellas include an elongated, rigid, support post with a pointed lower end including an auger designed to be rotated and driven into the sand by exerting a downward rotational force on the support post. However, horizontal and vertical forces of heavier wind, wind gusts, or subsequent pivotable movement of the umbrella frequently results in the umbrella being completely dislodged from the sand. Indeed, although these augers vertically stabilize the umbrellas by counteracting vertical lifting forces, they do not laterally stabilize the umbrellas from horizontal and angular forces that tend to move the umbrella post laterally, slowly widening the surrounding sand in which the auger has been driven and dislodging it from the sand. This can result in a hazardous condition since the wind, after dislodging the umbrella, will cause the umbrella to roll or tumble along the beach causing an extremely dangerous situation for other beachgoers.

Accordingly, there is a need in the art for an improved beach umbrella anchor which will increase the total static retention forces and the lateral stability of a beach umbrella by alleviating or preventing horizontal or vertical lifting forces, caused by steady winds and/or gusts, from dislodging the beach umbrella from the sand such that a beach umbrella may be used in a more stable, secure, and safe manner.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a beach umbrella anchor capable of receiving and fastening an umbrella therein while providing a means for weighing the umbrella down and providing lateral support that combats horizontal and angular forces.

Accordingly, the present disclosure provides a beach umbrella anchoring and stabilizing device including a support shaft and an anchoring container affixed to the support shaft. The support shaft includes a proximal end, a distal end, and a hollow interior adapted to receive a beach umbrella support post therein. The proximal end includes an opening providing access to the hollow interior and a fastener for fastening a beach umbrella support post within the hollow interior. The anchoring container includes an open top, a closed bottom, and a sidewall extending around the support shaft from the open top to the closed bottom. The sidewall defines a reservoir extending between the support shaft and the sidewall that is adapted to receive sand. The sidewall is positioned laterally outwardly with respect to the support shaft such that the anchoring container provides lateral support to the support shaft when the reservoir is filled with sand. In operation, the anchoring container is buried under the sand such that the anchoring container is positioned underneath the beach surface. The anchoring container is filled with sand to weigh the beach umbrella anchoring and stabilizing device down and to anchor it underneath the sand. The width of the anchoring container with respect to the support shaft in combination with the static force exerted thereon by the weight of the sand filled into the reservoir provides lateral support to the support shaft.

Another aspect of an example embodiment in the present disclosure is to provide a beach umbrella anchor providing lateral support to a beach umbrella mounted therein that also combats rotational forces. According, the beach umbrella anchoring and stabilizing device includes stabilizing vanes protruding radially outwardly from the support shaft and extending from the closed bottom to the distal end. Each of the stabilizing vanes define a broad surface adapted to engage sand when a rotational force is exerted onto the support shaft, thereby preventing rotation of the support shaft about a longitudinal axis thereof when the anchoring container is buried under the sand.

Yet another aspect of an example embodiment in the present disclosure is to provide a beach umbrella anchor providing a space for users to place their various beach accessories thereon. Accordingly, the beach umbrella anchoring and stabilizing device includes a beach accessory tray that is removably attachable to the support shaft. The beach accessory tray includes a central opening for mounting the beach accessory tray onto the support shaft and a fastener for fastening the beach accessory tray to the support shaft.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
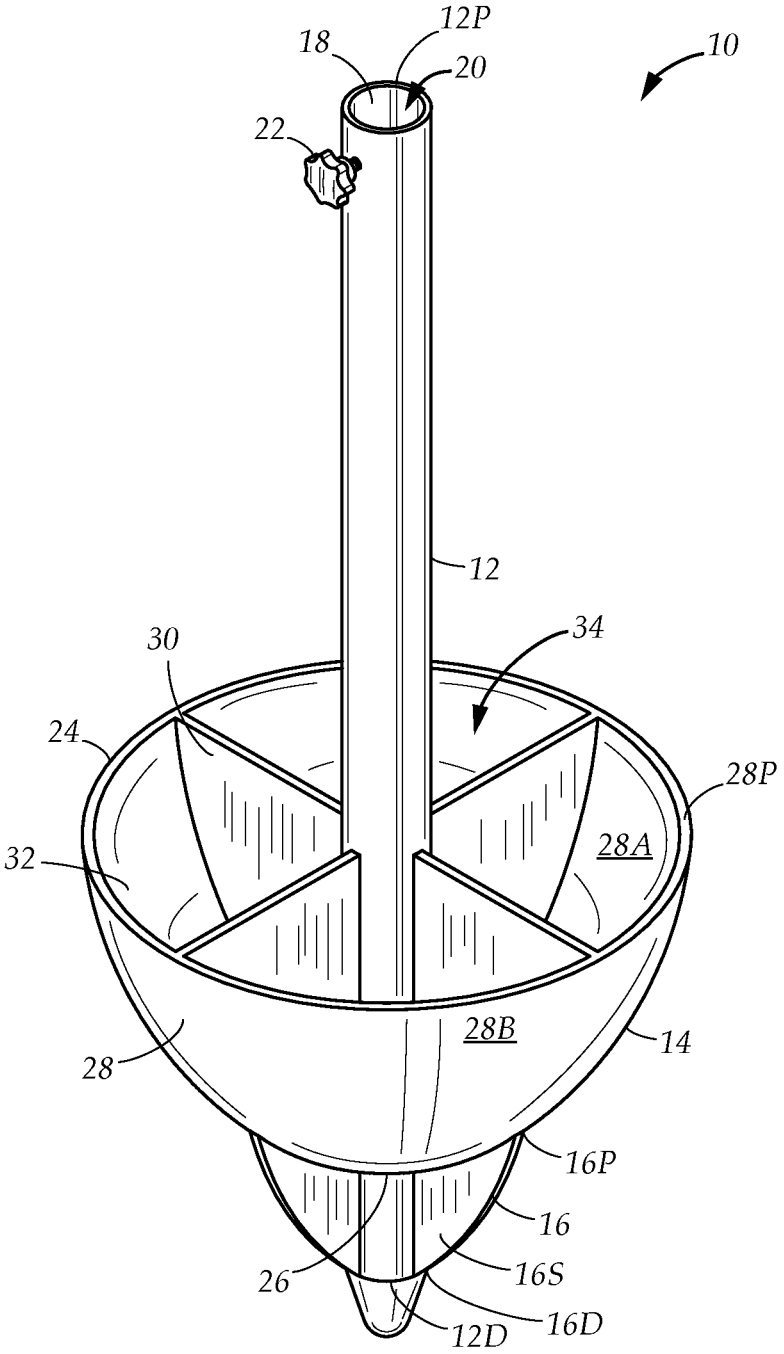
FIG. 1 is a perspective view of the beach umbrella anchoring and stabilizing device according to one embodiment of the present disclosure.

FIG. 1 illustrates a beach umbrella anchoring and stabilizing device 10 comprising an elongated support shaft 12 including a proximal end 12P and a distal end 12D opposite the proximal end 12P, an anchoring container 14 affixed to the support shaft 12, and a plurality of stabilizing vanes 16 affixed to the support shaft 12. The support shaft 12 includes a hollow interior 18 adapted to receive a beach umbrella support post therein. The proximal end 12P includes an opening 20 providing access to the hollow interior 18 and a fastener 22 for fastening a beach umbrella support post within the hollow interior 18. The distal end 12D is pointed to facilitate the penetration of sand, such as the sand defining the surface of a beach.

The anchoring container 14 includes an open top 24, a closed bottom 26 opposite the open top 24, a sidewall 28 extending around the support shaft 12 from the open top 24 to the closed bottom 26, and a plurality of partitions 30 extending radially inwardly from the sidewall 28 to the support shaft 12. The open top 24 is not affixed to the support shaft 12 while the closed bottom 26 is affixed to the support shaft 12 and adjacent to the distal end 12D of the support shaft 12.

The sidewall 28 defines a reservoir 32 extending between the support shaft 12, the open top 24, the closed bottom 26, and the sidewall 28 that is adapted to receive sand. The sidewall 28 includes an inner surface 28A, an outer surface 28B, and an upper perimeter edge 28P defining an opening 34 providing access to the reservoir 32. The sidewall 28 is annular with respect to the support shaft 12 and tapers in diameter from the open top 24 and upper perimeter edge 28P to the closed bottom 26 forming a concave bowl-shape. The partitions 30 define separate and discrete basins within the reservoir 32 that are individually adapted to receive sand. Each of the partitions 30 extends vertically upwardly or linearly from the closed bottom 26 toward the open top 24 defining a planar member or structure. Each of the partitions 30 also extends perpendicularly with respect to the support shaft 12. In some embodiments, each of the partitions 30 extends to the open top 24 such that the partitions 30 are flush with the upper perimeter edge 28P of the sidewall 28. The anchoring container 14 is adapted to be buried under sand to provide lateral support to the support shaft 12.

Figure 5A:
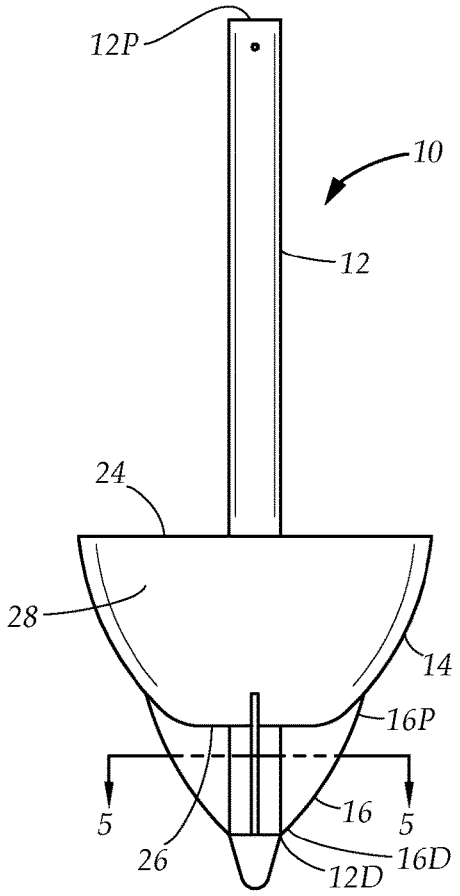
FIG. 5A is a side plan view of the beach umbrella anchoring and stabilizing device according to one embodiment of the present disclosure.
Figure 5:
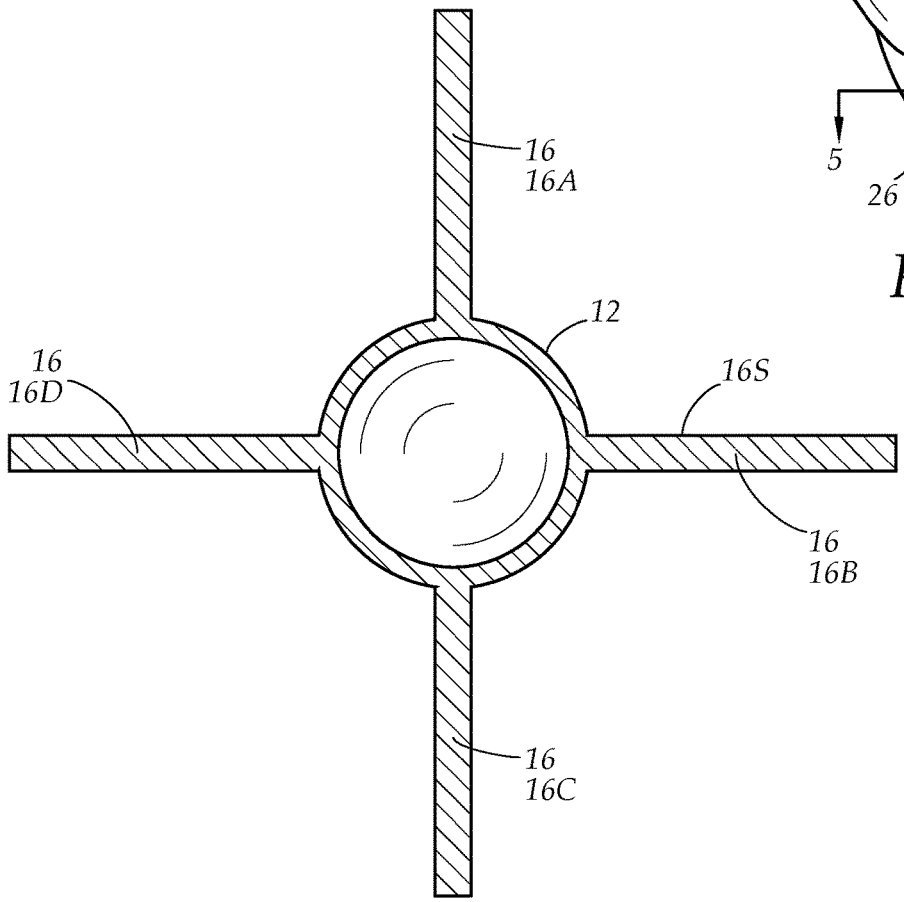
FIG. 5 is a cross-sectional view of the beach umbrella anchoring and stabilizing device across line 5-5 of FIG. 5A, illustrating the configuration of the stabilizing vanes with respect to the support shaft according to one embodiment of the present disclosure.

Referring now to FIG. 5 and FIG. 5A, in conjunction with FIG. 1, the stabilizing vanes 16 protrude outwardly from the support shaft 12 and extend from the closed bottom 26 of the anchoring container 14 to the distal end 12D of the support shaft 12. Each of the stabilizing vanes 16 includes a proximal end 16P affixed to the outer surface 28B of the sidewall 28 and a distal end 16D affixed to the distal end 12D of the support shaft 12. Each of the stabilizing vanes 16 taper in width from the proximal end 16P to the distal end 16D such that the stabilizing vanes 16 also taper in width from the closed bottom 26 of the anchoring container 14 toward the distal end 12D of the support shaft 12 defining an arcuate shape. The stabilizing vanes 16 are spaced at equal intervals around the support shaft 12 to provide equal support on all sides of the support shaft 12. Each of the stabilizing vanes 16 defines a broad surface 16S adapted to engage sand when a rotational force is exerted onto the support shaft 12. In this way, the stabilizing vanes 16 prevent rotation of the support shaft 12 about a longitudinal axis of the support shaft 12 when the anchoring container 14 is buried under the sand. In some embodiments, the stabilizing vanes include four stabilizing vanes 16A, 16B, 16C, 16D, each protruding orthogonally outwardly with respect to the support shaft 12. In other embodiments, the stabilizing vanes 16 are aligned with the partitions 30 of the anchoring container 14.

Figure 2:
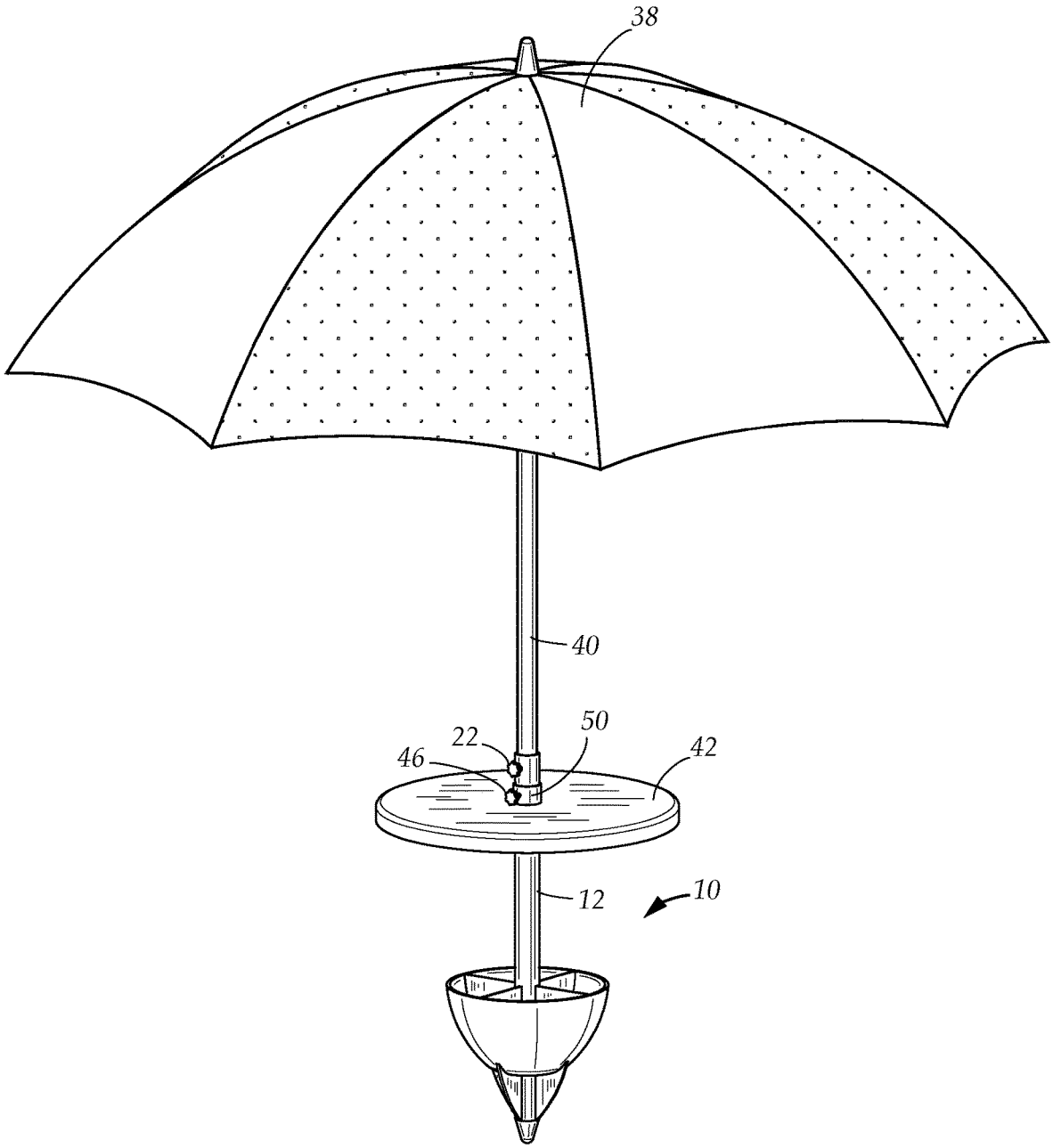
FIG. 2 is perspective view of the beach umbrella anchoring and stabilizing device, illustrating the beach accessory tray mounted onto the support shaft of the beach umbrella anchoring and stabilizing device and a beach umbrella support post mounted into the support shaft according to one embodiment of the present disclosure.
Figure 3:
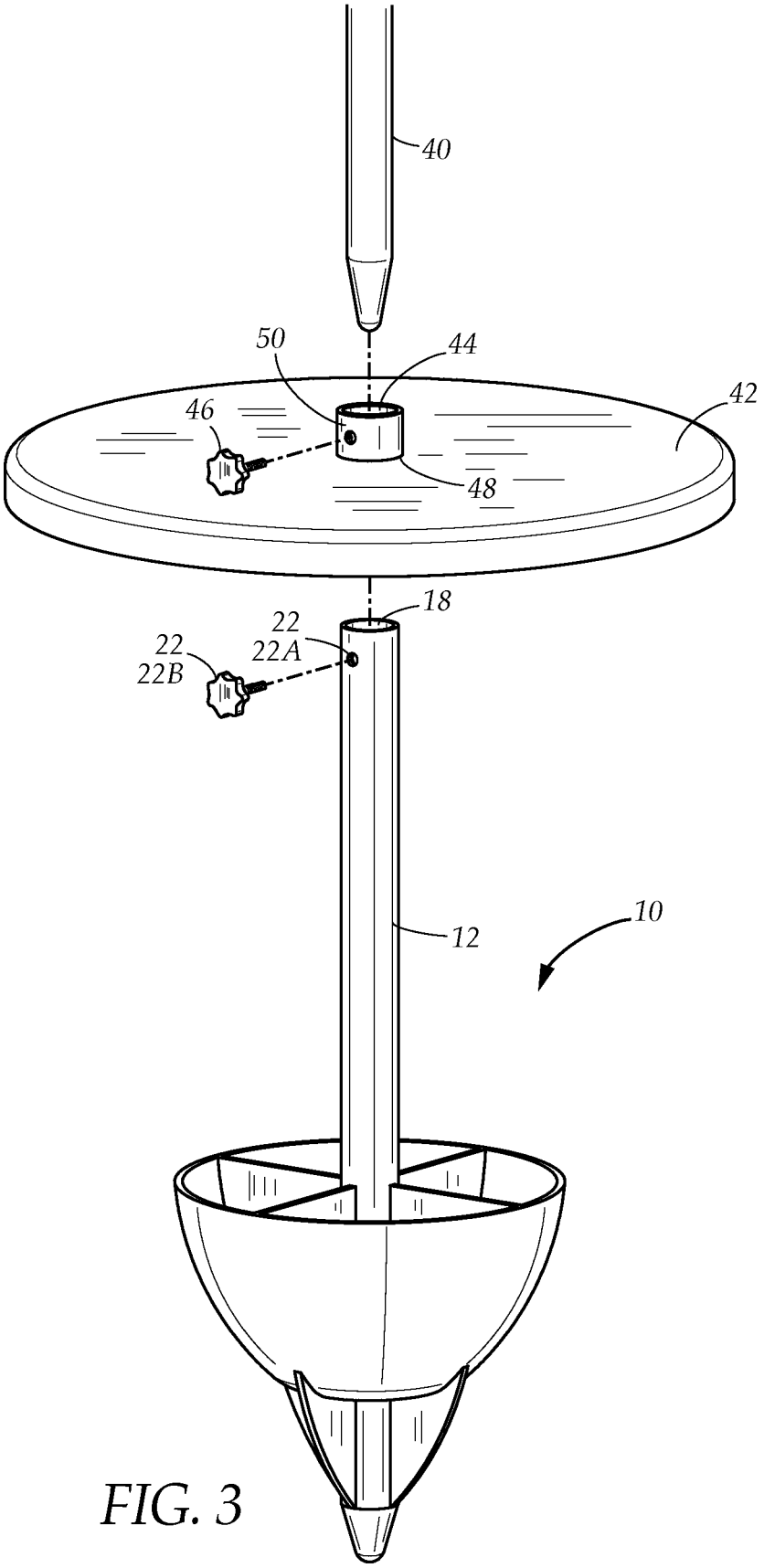
FIG. 3 is an exploded view of the bottom end of a beach umbrella support post, the beach accessory tray, and the beach umbrella anchoring and stabilizing device, illustrating one manner in which a beach umbrella support post and beach accessory tray may be mounted onto the beach umbrella anchoring and stabilizing device according to one embodiment of the present disclosure.
Figure 4:
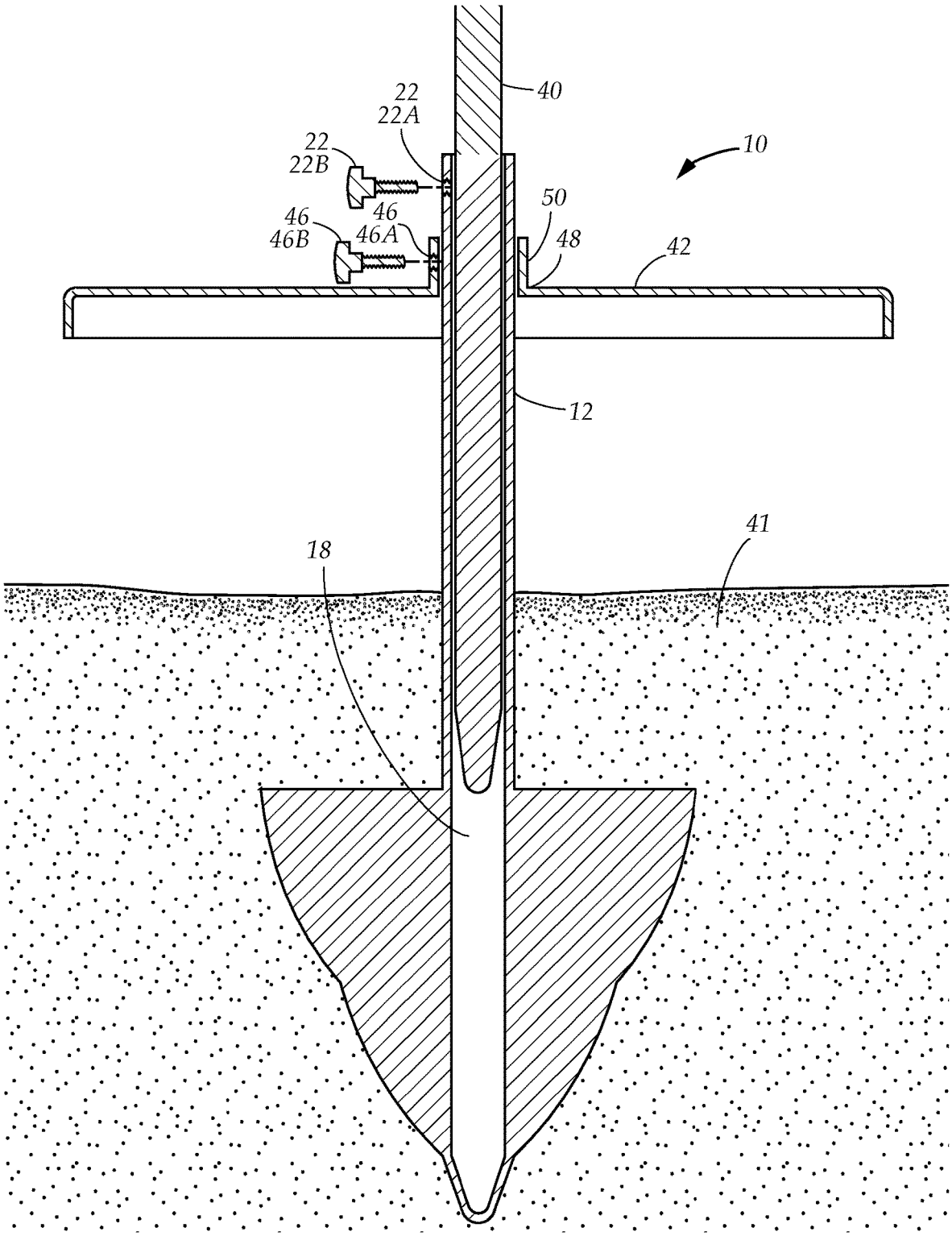
FIG. 4 is a cross-sectional view of the beach umbrella anchoring and stabilizing device buried in the sand with a beach accessory tray mounted onto the support shaft and a beach umbrella support post mounted into the support shaft, illustrating one manner in which the anchoring container and stabilizing vanes of the beach umbrella anchoring and stabilizing device may be positioned after being buried under the sand and one manner in which the beach accessory tray and the beach umbrella support post may be positioned on the support shaft according to one embodiment of the present disclosure.

Referring now to FIG. 2, FIG. 3, and FIG. 4, the fastener 22 of the support shaft 12 comprises an aperture 22A and a hand knob 22B. The aperture 22A is adapted to receive the hand knob 22B therethrough such that the hand knob 22B may extend through the aperture 22A into the hollow interior 18 to engage a beach umbrella support post 40 mounted into the support shaft 12. In embodiments, the aperture 22A is threaded so as to threadably engage the hand knob 22B and provide a means for securing the hand knob 22B in position within the hollow interior 18.

In operation, the beach umbrella 38 is supported by the beach umbrella anchoring and stabilizing device 10 by mounting the beach umbrella support post 40 into the hollow interior 18 of the support shaft 12. Note, the hollow interior 18 includes a universally sized diameter that is larger than a diameter of the beach umbrella support post 40 such that the support shaft 12 may receive the beach umbrella support post of any variety of beach umbrellas therein. Once mounted into the support shaft 12, the beach umbrella support post 40 may slide longitudinally along the length of the hollow interior 18 so as to adjust the height of the beach umbrella 38 relative to the sand 41 as desired by a user. The beach umbrella support post 40 may then be secured in position by rotating the hand knob 22B through the aperture 22A and into the hollow interior 18 to engage the beach umbrella support post 40. The hand knob 22B is then tightened against the beach umbrella support post 40 to fasten the beach umbrella support post 40 in position within the support shaft 12.

In embodiments, the beach umbrella anchoring and stabilizing device 10 further comprises a beach accessory tray 42 that is removably attachable to the support shaft 12. The beach accessory tray 42 comprises a planar member including a central opening 44 for mounting the beach accessory tray 42 onto the support shaft 12 and a second fastener 46 for fastening the beach accessory tray 42 to the support shaft 12. The central opening 44 includes a perimeter edge 48 having a collar 50 including the second fastener 46. In embodiments, the second fastener 46 comprises an aperture 46A extending through the collar 50 and a hand knob 46B. The aperture 46A is adapted to receive the hand knob 46B therethrough such that the hand knob 46B may extend through the aperture 46A into the collar 50 to engage the support shaft 12 when the beach accessory tray 42 is mounted thereon. In some embodiments, the aperture 46A is threaded so as to threadably engage the hand knob 46B and provide a means for securing the hand knob 46B in position within the hollow interior 18. The beach accessory tray 42 may slide longitudinally along the length of the support shaft 12 so as to adjust the height of the beach accessory tray 42 relative to the sand 41.

Figure 6:
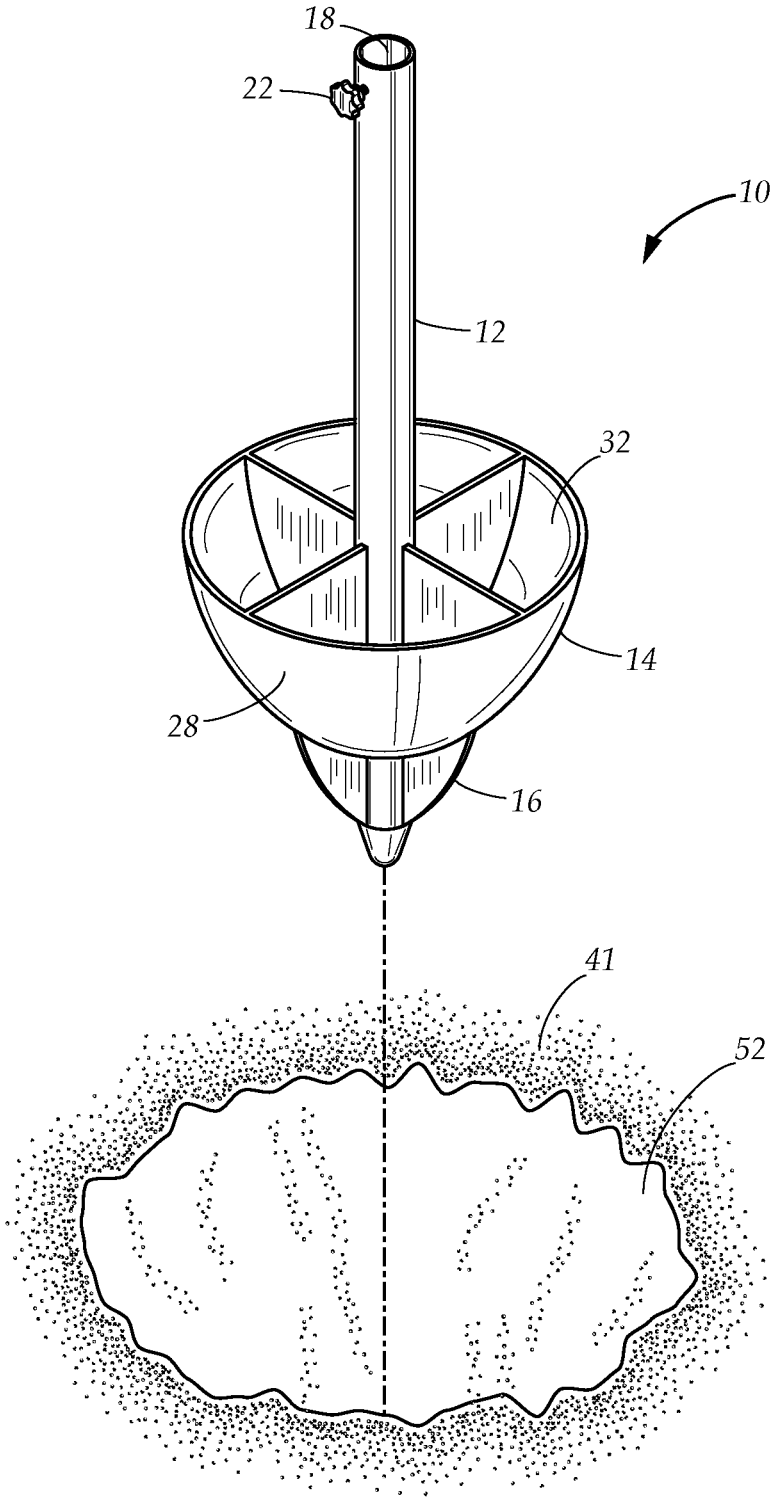
FIG. 6 is a perspective view of the beach umbrella anchoring and stabilizing device going into a hole dug in the sand, illustrating one manner in which the beach umbrella anchoring and stabilizing device may be inserted into the sand prior to being buried according to one embodiment of the present disclosure.
Figure 7:
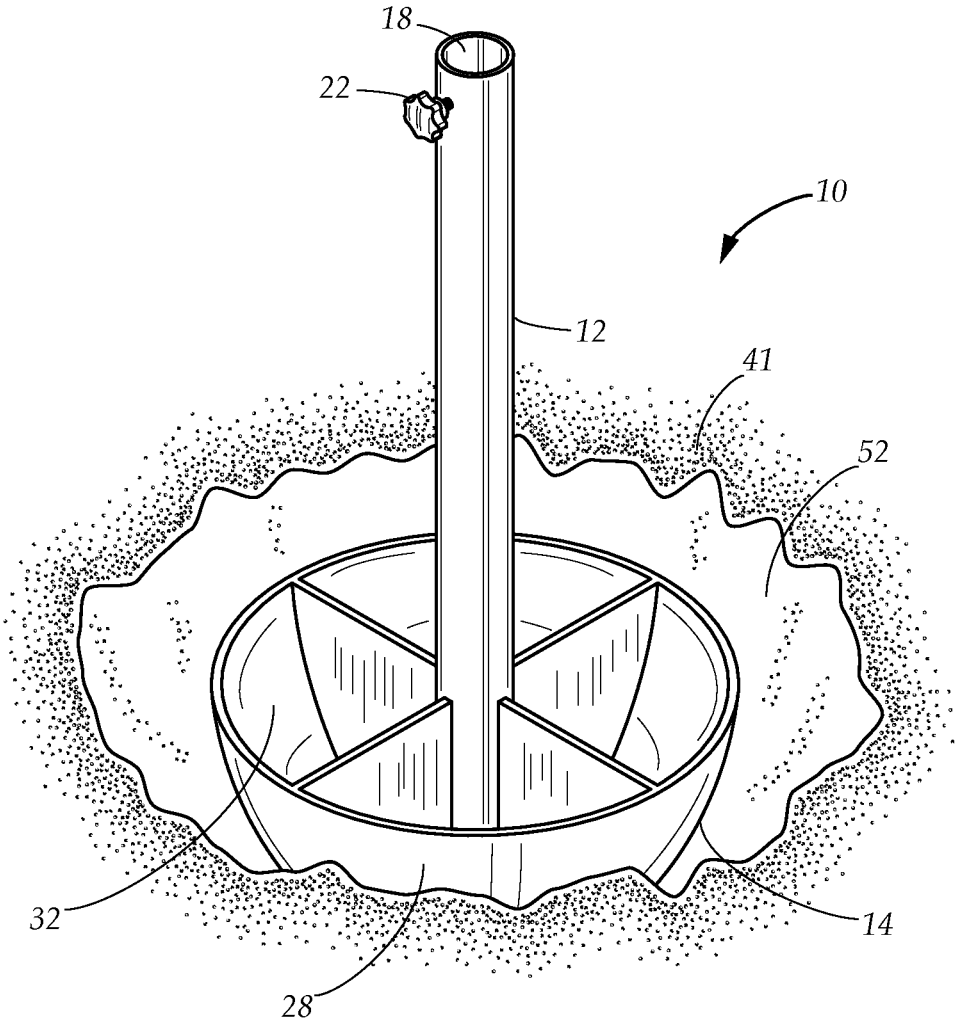
FIG. 7 is a perspective view of the anchoring container of the beach umbrella anchoring and stabilizing device positioned in a hole dug in the sand, illustrating the anchoring container positioned upwardly with respect to the sand surface before the anchoring container is buried in the sand according to one embodiment of the present disclosure.
Figure 8:
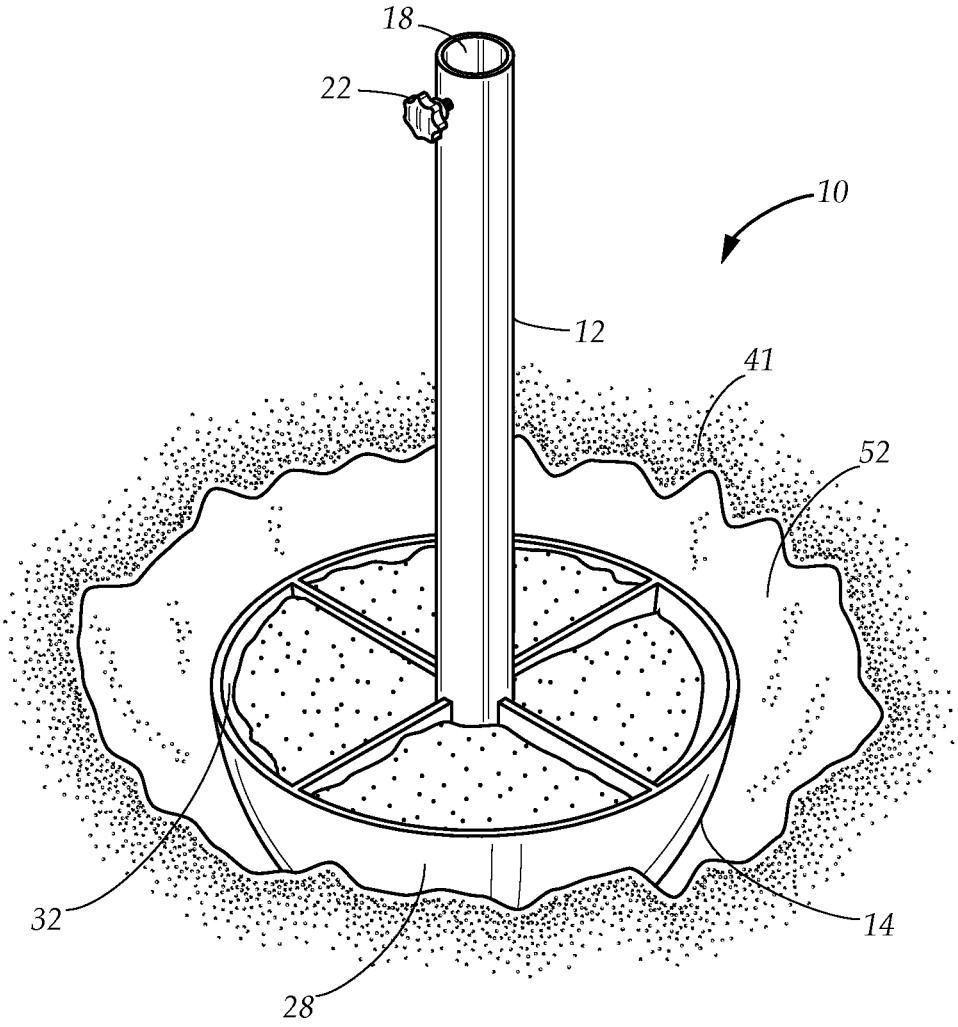
FIG. 8 is a perspective view of the anchoring container of the beach umbrella anchoring and stabilizing device positioned in a hole dug in the sand, illustrating the anchoring container filled with sand prior to being buried in the sand according to one embodiment of the present disclosure.
Figure 9:
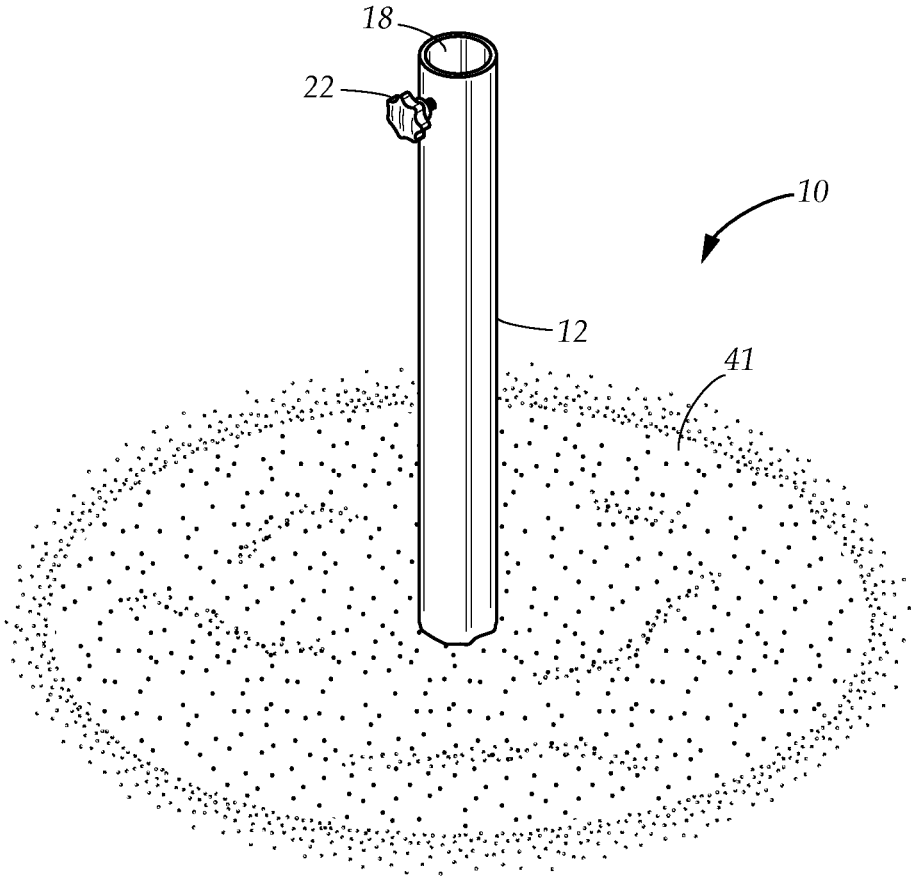
FIG. 9 is a perspective view of the anchoring container of the beach umbrella anchoring and stabilizing device buried in the sand according to one embodiment of the present disclosure.
Figure 10:
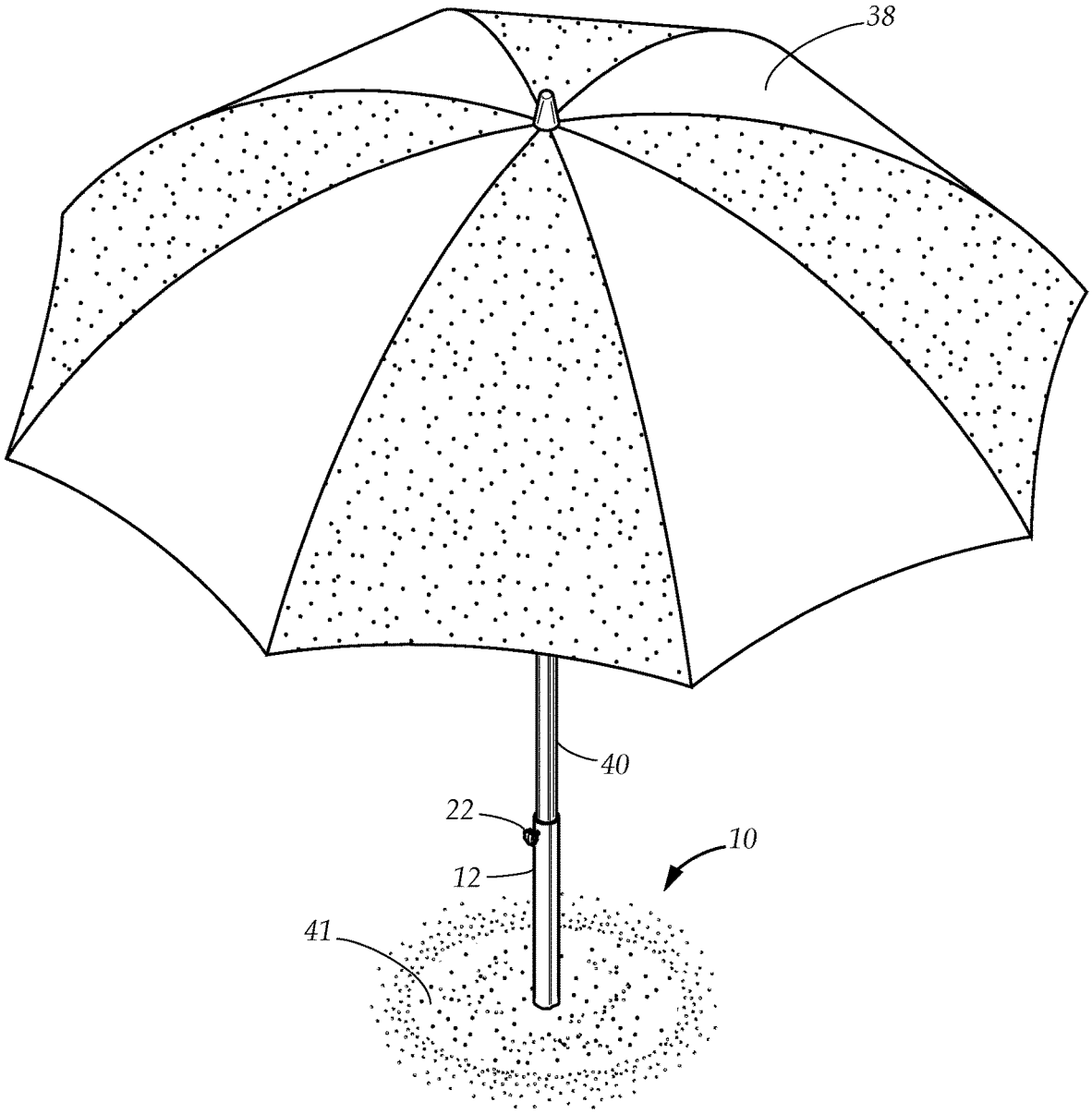
FIG. 10 is a perspective view of the anchoring container of the beach umbrella anchoring and stabilizing device buried in the sand, illustrating the beach umbrella anchoring and stabilizing device anchoring and stabilizing a beach umbrella mounted into the support shaft thereof according to one embodiment of the present disclosure.

Referring now to FIG. 6, FIG. 7, FIG. 8. FIG. 9, and FIG. 10, in one operation of the beach umbrella anchoring and stabilizing device 10, a user first digs a hole 52 in the sand 41 large enough to accommodate the anchoring container 14 and the stabilizing vanes 16 therein. The user then places the anchoring container 14 into the hole 52, orienting the support shaft 12 in a vertical upright orientation. Next, while maintaining the support shaft 12 in the vertical upright orientation, the user fills and packs the reservoir 32 with sand and also fills and packs the area between the sidewall 28 and the hole 52 with sand until the anchoring container 14 and stabilizing vanes 16 are completely buried underneath the sand 41. Finally, the user mounts the beach umbrella 38 into the hollow interior 18 of the support shaft 12, securing the beach umbrella 38 at a desired height with respect to the sand 41 by fastening the beach umbrella support post 40 within the support shaft 12 using the fastener 22.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly. The term "substantially" is defined as at least 95% of the term being described and/or within a tolerance level known in the art and/or within 5% thereof.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a beach umbrella anchoring and stabilizing device. The disclosure is illustrated by example in the drawing figures, and throughout the written description. It should be understood that numerous variations are possible, while adhering to the inventive concept. Such variations are contemplated as being a part of the present disclosure.

What is claimed is:

1. A beach umbrella anchoring and stabilizing device, comprising:

an elongated support shaft including a proximal end, a distal end, the proximal end opposite the distal end, and a hollow interior adapted to receive a beach umbrella support post therein, the proximal end including an opening providing access to the hollow interior and a fastener for fastening a beach umbrella support post within the hollow interior, the hollow interior including a diameter larger than a diameter of a beach umbrella support post;

an anchoring container affixed to the support shaft, the anchoring container including an open top, a closed bottom adjacent to the distal end of the support shaft, the open top opposite the closed bottom, and a sidewall extending around the support shaft from the open top to the closed bottom, the sidewall defining a reservoir extending between the support shaft and the sidewall that is adapted to receive sand, the sidewall includes an upper perimeter edge defining an opening providing access to the reservoir, the anchoring container providing lateral support to the support shaft when the anchoring container is buried under the sand;

a plurality of stabilizing vanes protruding radially outwardly from the support shaft, the stabilizing veins extending from the closed bottom of the anchoring container to the distal end, each of the stabilizing vanes defining a broad surface adapted to engage the sand when a rotational force is exerted onto the support shaft, thereby preventing rotation of the support shaft about a longitudinal axis thereof when the anchoring container is buried under the sand; and a plurality of partitions extending radially inwardly from the sidewall of the anchoring container to the support shaft, the partitions defining separate and discrete basins within the reservoir that are adapted to receive sand therein, each of the partitions extending vertically upwardly from the closed bottom toward the open top defining a planar member;

wherein the stabilizing vanes are aligned with the partitions.

2. The beach umbrella anchoring and stabilizing device of claim 1, wherein the sidewall is annular with respect to the support shaft and tapers in diameter from the open top to the closed bottom forming a concave bowl-shape.

3. The beach umbrella anchoring and stabilizing device of claim 1, wherein the stabilizing vanes taper in width from the closed bottom toward the distal end defining an arcuate shape.

4. The beach umbrella anchoring and stabilizing device of claim 1, wherein the stabilizing vanes are spaced at equal intervals around the support shaft.

5. The beach umbrella anchoring and stabilizing device of claim 1, wherein stabilizing vanes include four stabilizing vanes each protruding orthogonally outwardly with respect to the support shaft.

6. The beach umbrella anchoring and stabilizing device of claim 1, wherein the stabilizing vanes are affixed to the closed bottom and the support shaft.

7. The beach umbrella anchoring and stabilizing device of claim 1, wherein the distal end is pointed to facilitate penetration of a surface of the sand.

8. The beach umbrella anchoring and stabilizing device of claim 1, wherein the partitions extend perpendicularly with respect to the support shaft.

9. The beach umbrella anchoring and stabilizing device of claim 8, wherein each of the partitions extends to the open top such that the partitions are flush with the upper perimeter edge of the sidewall.

10. The beach umbrella anchoring and stabilizing device of claim 9, wherein the fastener comprises a threaded aperture and a hand knob, the threaded aperture adapted to receive the hand knob therethrough such that the hand knob may extend through the aperture into the hollow interior to engage a beach umbrella support post mounted into the support shaft.

11. The beach umbrella anchoring and stabilizing device of claim 10, further comprising a beach accessory tray removably attachable to the support shaft, the beach accessory tray including a central opening for mounting the beach accessory tray onto the support shaft and a fastener for fastening the beach accessory tray to the support shaft.

12. The beach umbrella anchoring and stabilizing device of claim 11, wherein the central opening includes a perimeter edge having a collar including the fastener.

13. The beach umbrella anchoring and stabilizing device of claim 12, wherein the fastener comprises a threaded aperture extending through the collar and a hand knob, the threaded aperture adapted to receive the hand knob therethrough such that the hand knob may extend through the aperture into the collar to engage the support shaft when the beach accessory tray is mounted thereon.

* * * * *